United States Patent [19]

Crittenden

[11] Patent Number: 4,863,021

[45] Date of Patent: Sep. 5, 1989

[54] BULK BIN BAG CASSETTE

[75] Inventor: Bradley J. Crittenden, Burnaby, Canada

[73] Assignee: MacMillan Bloedel Limited, Vancouver, Canada

[21] Appl. No.: 190,824

[22] Filed: May 6, 1988

[51] Int. Cl.[4] ..... B65D 73/02

[52] U.S. Cl. ..... 206/328; 229/115

[58] Field of Search ..... 229/115; 206/328, 334, 206/329, 387

[56] References Cited

U.S. PATENT DOCUMENTS

| | | | |
|---|---|---|---|
| 1,814,561 | 7/1931 | Krumm | 229/115 |
| 4,313,542 | 2/1982 | Roberts et al. | 229/115 |
| 4,492,333 | 1/1985 | Roberts | 209/115 |

FOREIGN PATENT DOCUMENTS

| | | | |
|---|---|---|---|
| 56206 | 2/1936 | Norway | 229/115 |

*Primary Examiner*—Joseph Man-fu Moy

*Attorney, Agent, or Firm*—C. A. Rowley

[57] ABSTRACT

A new bag cassette having a main bottom panel formed by a diagonal panel defined by a pair of spaced parallel fold lines and a pair of side panels is used to protect and position a bag and for squaring a carton. The bag spout is held in a reinforcing panel connected to the main bottom panel by a spacing panel and the bag is protected by the envelope formed by folding the two side panels perpendicular to the diagonal panel. To square a box having a cross section substantially corresponding with the periphery of the main panel, the cassette is inserted into the box with a diagonal panel extending diagonally between the pair of opposed corners of the box and with the side panels in folded enveloping position substantially perpendicular to the diagonal panel. As the cassette is moved down into the box it tends to force the box into squared position. Folding out of the side panels into a position parallel to the diagonal panel completes the squaring and positions the cassette in the bottom of the box.

10 Claims, 4 Drawing Sheets

BULK BIN BAG CASSETTE

FIELD OF THE INVENTION

The present invention relates to a bag cassette, more particularly the present invention relates to a bag cassette for use in a carton to position the bag and at the same time square the carton when the cassette is properly inserted and positioned within the carton.

BACKGROUND OF THE PRESENT INVENTION

A variety of bag cassettes have been proposed and are being used for inserting bags into boxes so that the bags are oriented in the box and in some cases a spout position relative to the side wall of the box in alignment with an access opening. Generally such bag cassettes include a main bottom wall which may be divided by fold lines into a central rectangular panel and a pair of rectangular side panels. Each side panel has connected to its edge remote from its connection to the central panel a spacing panel which in turn is provided with a reinforcing flap connected thereto by a fold line substantially parallel to the fold line connecting the spacing panel to the rectangular side panel. In other words, the blank forming the cassette is composed of a substantially rectangular panel divided by a plurality of parallel fold lines into a first reinforcing flap, a first spacing panel, a first side panel, a central panel, a second side panel, a second spacing panel and a second reinforcing panel. The central panel has a width between its two fold line connections with the side panels equal to the combined widths of the two spacing panels and normally to provide best protection for the bag which will be enveloped by the cassette blank when forced, the two side panels will be substantially the same size.

Such a cassette with the bag positioned against the main bottom panel (two side panels and central panel) and contained within the reinforcing flaps is normally inserted into the box with the central panel extending perpendicular to a pair of side walls and substantially centered on these side walls and then the two side panels are folded from a position perpendicular to the central panel to a position parallel thereto to fill out the bottom of the box.

Preferably the spout of the bag contained within the cassette will extend through one of the reinforcing flaps and be connected thereto so that on filling of the bag the reinforcing flap is folded into face to face relationship with the inside of its corresponding wall in the carton and will bring the spout into alignment with a suitable access opening in the wall of the carton thereby to automatically position the spout.

It will be apparent that with this type of cassette the box must be substantially squared before the cassette can be introduced and only two walls of the box have a cooperating reinforcing flap (and spacing wall) to reinforce the wall. Multi-walled containers, particularly large bulk containers that are relatively deep (say a container of about 1 cubic meter) it may well be difficult to properly position the cassette to insure that it extends from end to end of the carton and that the fold lines connecting the spacing panels to the side panels align with the desired opposed pair of inside walls of the box to ensure that the cassette is properly positioned to obtain maximum benefit and that on filling the bag, if a spout is held by reinforcing flap, that the spout automatically aligns with the aperture provided in the wall of the box.

BRIEF DESCRIPTION OF THE PRESENT INVENTION

It is an object of the present invention to provide a bag cassette particularly suited for squaring multi-walled containers.

Broadly, the present invention comprises a cassette or a blank for forming a cassette comprising a main body panel having a pair of spaced parallel diagonal fold lines extending substantially diagonally across said main bottom panel and dividing said main bottom panel into a diagonal panel and a pair of side panels, at least one main flap connected to each of said side panels by a first fold line, a second fold line on each of said main flaps, said second fold line being parallel to said first fold line and dividing its respective said main flap into a spacing panel and a reinforcing flap, the spacing between said diagonal fold lines being substantially equal to the sum of spaces between said first and said second fold lines on a pair of flaps connected one to each of said side panels.

Preferably a selected one of said reinforcing flaps will be provided with means for securing a spout of a bag to be contained in position in said cassette.

Preferably the cassette will further comprise a collapsed bag having a main body portion substantially coextensive with said main bottom panel, said spacing panels being folded around said bag in a position substantially perpendicular to its respective said side panel on its respective said first fold line, each said reinforcing flap being folded substantially perpendicular to its respective spacing panel on its respective of said second fold lines and said side panels are folded on said pair of parallel diagonal fold lines each into a position substantially perpendicular to said diagonal panel.

The present invention also relates to a method of setting up a carton having a least four side walls into a squared position comprising inserting a cassette into said carton said cassette having formed by a main bottom panel divided into a pair of side panels one on each side of a diagonal panel by a pair of fold lines extending substantially diagonally of said main bottom panel, said bottom panel having essentially the same dimensions as the inside of said carton when said carton is in squared position, said cassette being inserted into said carton with said diagonal panel extending substantially diagonally of said carton by moving the first end of said diagonal panel into a bottom corner of said box with said diagonal panel extending upwardly and diagonally of said carton, forcing the end of said diagonal panel remote from said first end downwardly in said carton into position adjacent the bottom corner diagonally opposite said first bottom corner, folding said side panels into a position substantially parallel with said diagonal panel to move the outer edges of said side panels into position adjacent their corresponding inner side walls of said carton thereby to ensure said carton is in squared condition and said cassette properly positioned in said carton.

Preferably the bag of the cassette is connected to a filling spout and as the bag is filled it forces reinforcing flaps connected to said side panels into face to face relationship with their respective inner side walls of the carton.

Preferably one of said reinforcing flaps has connected thereto a spout that projects through the reinforcing flap and wherein filling of said bag forces said spout into a corresponding opening in a side wall of said carton against which said selected reinforcing flap is moved by filling of said bag.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

The present invention will be described in relation to a rectangular container and therefore in relation to a rectangular blank, however it will be understood that other shapes may be used with corresponding shaped cartons and the shape of the blank adjusted accordingly provided a diagonal can be established between corners of the carton.

Figure 1:
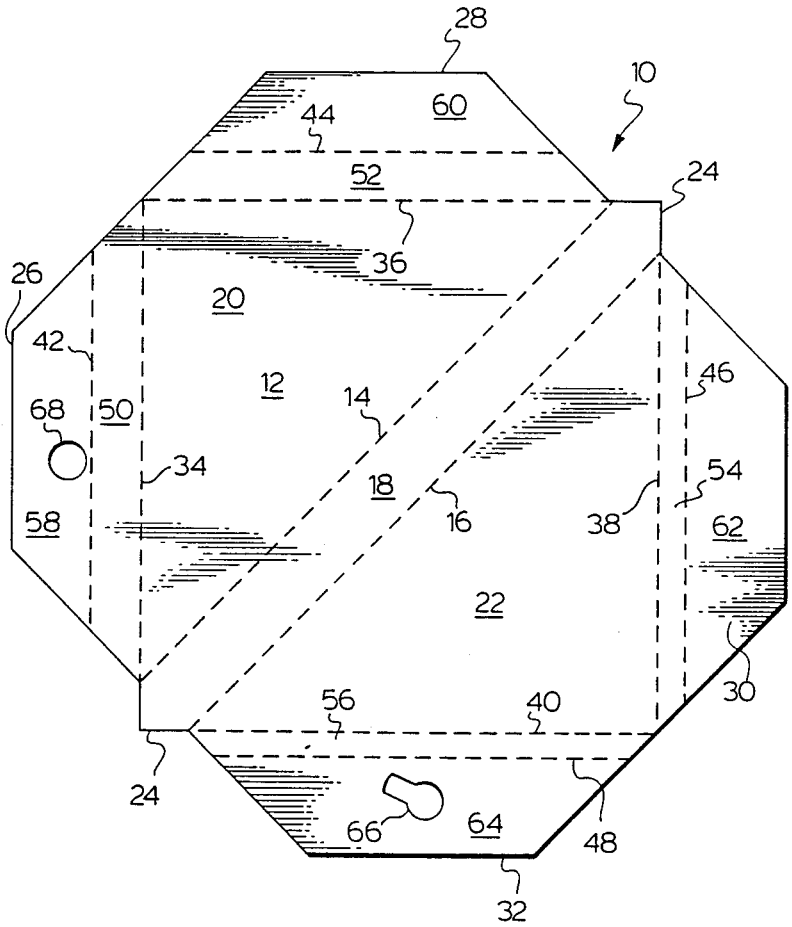
FIG. 1 is a plan view of a blank for forming a cassette in accordance with one embodiment of the present invention.

The blank 10 shown in FIG. 1, preferably will be made of corrugated board, i.e. a pair of kraft paper liners spaced by a corrugated medium, cut and scored to form the blank as illustrated at 10. This blank 10 is for a carton of square cross sections and has a main bottom panel or wall 12 which is divided by a pair of diagonal substantially parallel fold lines 14 and 16 into a central diagonal panel 18 and a pair of side panels 20 and 22. The panels 20 and 22 are substantially triangular in shape.

In the illustrated arrangement the axial ends of the central panel 18 are pointed as indicated at 24 so that these corners may extend right into the corner of the carton as will be described hereinbelow but this is not essential and may be deleted. Each of the triangular side panels 20 and 22 has a pair of main flaps 26, 28, 30 and 32 foldably connected thereto via fold lines 34, 36, and 40. These fold lines 34, 36, 38 and 40 delineate the outer periphery of the bottom panel 12 and two sides of each of the side panels.

Each of these main flaps 26, 28, 30 and 32 is divided by a fold line 42, 44, 46 and 48 respectively into a spacing panel 50, 52, 54, and 56 respectively and a reinforcing flap 58, 60, 62, and 64 respectively. It will be noted that the connecting panels 50 and 52 are wider than the connecting panels 54 and 56 in the illustrated arrangement, i.e. the spacings between the fold lines 40 and 42 and say 38 and 46 are different. This difference in spacing or width of spacing panels 50, 52 and 54, 56 is to accommodate the projection of an emptying spout 72 on a bag 70 (see FIG. 3) as will be described in more detail hereinbelow.

In the illustrated arrangement the panel 64 is provided with a key hole shaped opening 66 adapted to lock a flanged spout 72 to the flap 64 is shown. The narrow end of the slot 66 aligns with a hole 68 in the flap 58 when the cassette is in clsoed position as will be described hereinbelow.

Figure 2:
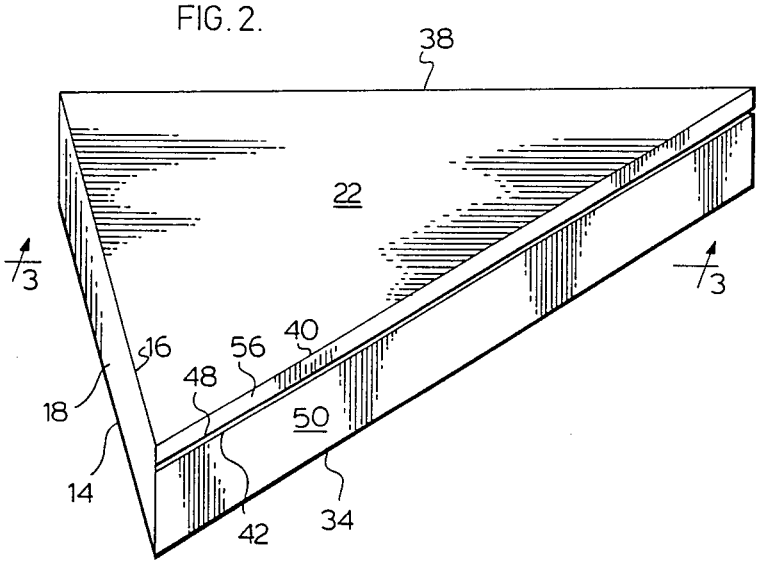
FIG. 2 is an isometric view of a cassette constructed in accordance with the present invention.

FIG. 2 shows the cassette with a bag contained therein folded into a closed position ready for shipment and storage. It will be noted that the combined widths of the spacing panels 50 and 56 (and thus of panels 52 and 54 which are the same width as panels 50 and 56 respectively) which is equal to the spacing between the fold lines 14 and 16, i.e. the width of the panel 18, so that the sides 20 and 22 when the cassette is closed are substantially parallel and substantially perpendicular to the panel 18 to permit easy stacking and storage.

In the arrangement shown in FIG. 2 the triangular sections 24 have been eliminated from the ends of the panel 18.

Figure 3:
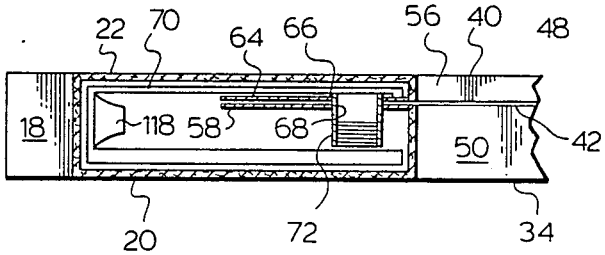
FIG. 3 is a section along the line 3—3 of FIG. 2.
Figure 4:
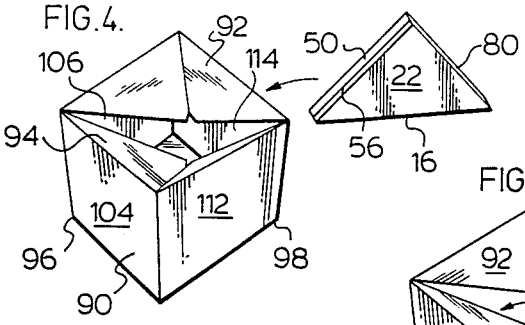
FIGS. 4, 5, 6, 7 and 8 illustrate the sequence of insertion and unfolding of the cassette in a carton to square the carton and position the cassette relative to the carton.

It will be clearer from FIG. 3 how a bag 70 forming part of the cassette to be filled is incorporated within the cassette structure formed of corrugated board. The bag 70 covers substantially the full area of the bottom panel 12 and is folded into U shape configuration following the diagonal panel 18 and the two side panels 20 and 22. Emptying spout 72 has an annular encircling flange 74 spaced from the body of the bag 70 by a distance substantially equal to the thickness of the flange 64. The bag 70 is fixed to the flap 64 via spout 72 by passing the spout 72 and flange 74 through the large end of aperture 66 and then moving the spout 72 into the narrow end of aperture 66 so that the flap 64 is received between the bag 70 and flange 74 to lock the spout 72, thus the bag 70, to the flap 64 and thus to blank 10. This is done with the blank as shown in FIG. 1 and the cassette positioned above the bottom panel 12 with the spout 72 projecting upwardly therefrom adjacent the fold line 40. The flap 32 is then folded along the fold line 40 and then along the fold line 48 to move the panel 56 into a position perpendicular to the side panel 22 and the reinforcing panel 64 into a position parallel to the side panel 22.

The flange 74 passes through the large end of the aperture 66 then the bag and blank 10 are moved relatively to slide the spout 72 into the narrow portion of the opening 66 and position the bag in proper position over the bottom panel 12. Flaps 26,28 and 30 may then be folded similarly to the flap 32 to position their respective spacing panels 50, 52 and 54 perpendicular to the bottom panel 12 and their respective reinforcing flap 58, 60 and 62 substantially parallel to the bottom panel 12. In particular flaps 50 and 58 are parallel to the side panel 20 and the flaps 62 and 64 are parallel to the side panel 22.

The main bottom panel 12 is then folded along the lines 14 and 16 to place the central diagonal panel 18 in a position substantially perpendicular to the side panels 20 and 22. This moves the reinforcing panel 58 into face to face relationship with the panel 64 and the spout 72 projects through the aperture 68 to be contained within the cassette and tend to hold the cassette in closed position. Similarly the reinforcing flaps 60 and 62 are positioned in face to face relationship by the folding on lines 14 and 16 (see FIG. 3).

The folded cassette which has been generally indicated at 80 in FIGS. 4 to 7 inclusive is used with a box such as the box 90. The box 90 incorporates an automatic closing feature the subject matter of applicant's corresponding U.S. application Ser. No. 122,930 filed Nov. 19, 1987 inventors Lau and Gillard (case 230) which is schematically indicated by the triangular closure panels 92 and 94 that move into close position on squaring of the box. Obviously the cassette may also be used with other boxes.

Figure 5:
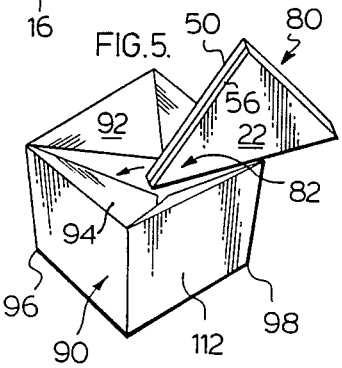
Figure 6:
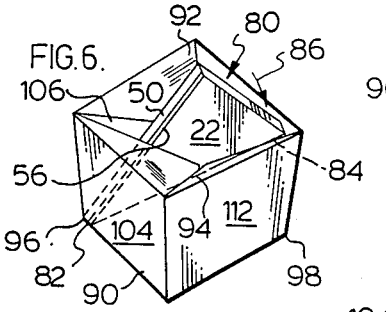
Figure 7:
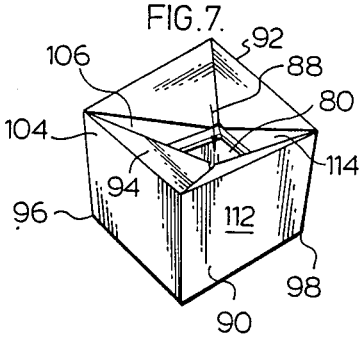
Figure 8:
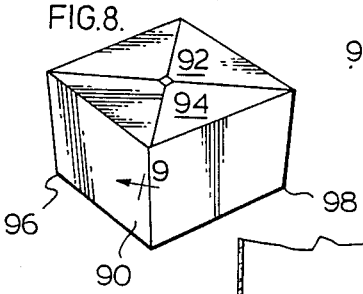

As illustrated, before the box is completely squared, the cassette 80 is moved into the box as shown in FIG. 5 with the axial end 82 of diagonal panel 18 moving downward and into the bottom corner of the box 90 corresponding with one of the end edges of the triangular top closure panels 92 and 94, i.e. as indicated at 96.

Figure 9:
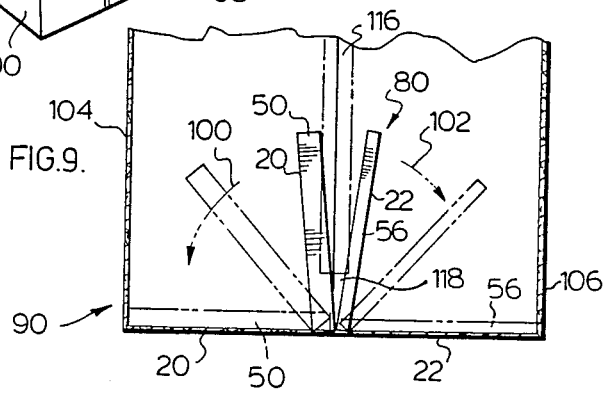
FIG. 9 is a section along the line 9—9 of FIG. 7 schematically illustrating the unfolding of the cassette and squaring of the carton.

The trailing end 84 of the cassette 80, i.e. the end of the cassette which will always remain closest to the operator assuming the operator is handling the cassette in a normal manner is then moved downward as indicated by the arrow 86 to move the end 84 into the corner 98 diagonally opposite the corner 96. This movement tends to square the box as the size of the cassette is correlated with the size of the box 90 so that when the cassette 80 is forced into the bottom of the container 90 as indicated by the arrow 88 in FIG. 7 and as shown when the movement is completed in FIG. 9 the corner 98 of the box 90 can be forced toward the end 84 to tend to square the box. Referring to FIG. 9 it will be noted that the cassette 80 is first moved to the solid line position, i.e. extending diagonally across the box 90 from the corner 96 toward the corner 98, the cassette side walls 20 and 22 are then moved as indicated by the arrows 100 and 102 respectively from the solid line position into the bottom dash line position which at the same time moves the side walls 104 and 106 (shown in FIG. 9) of the carton 90 from their dotted line position to their solid line position as indicated by the arrows 108 and 110 to complete the squaring up operation. The two remaining side walls 112 and 114 of the carton 90 obviously are similarly moved into squared position to completely square the box or carton 90.

Figure 10:
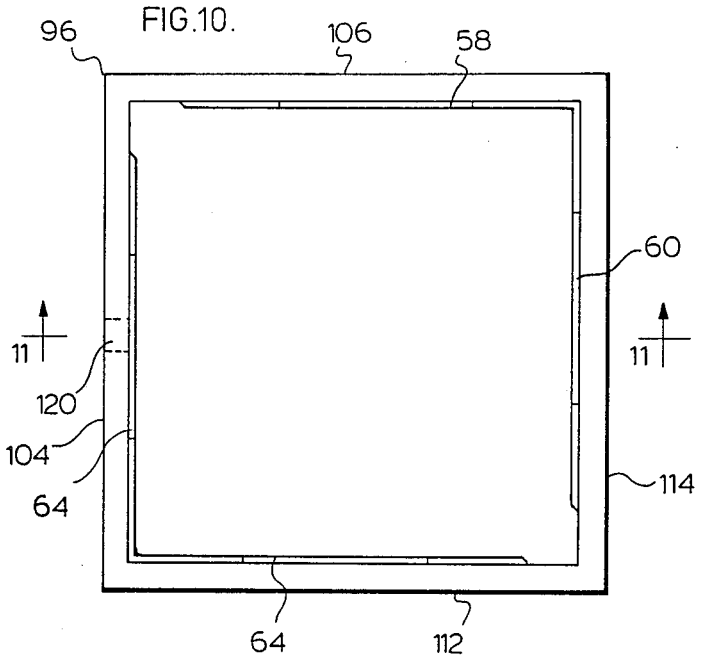
FIG. 10 is a plan view of an open carton with a cassette in place and in position to be filled.
Figure 11:
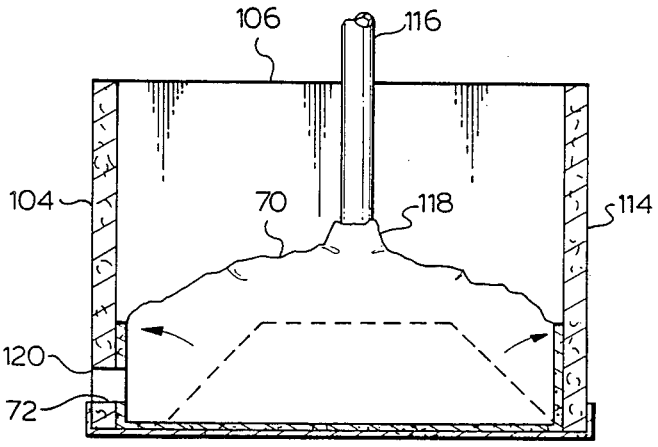
FIG. 11 is a schematic section along the lines 11—11 of FIG. 10 showing the partially filled bag inflated against the reinforcing flaps and forcing the spout into the access opening in the carton wall.

In FIGS. 4 to 8 inclusive the filler tube for filling the bag 70 has been omitted however it is illustrated at 116 in phantom lines in FIG. 9 and is included in FIGS. 10 and 11. This filler tube 116 will be connected to a filler spout 118 (see FIGS. 3, 9 and 11) communicating with the interior of the bag 70. The filler spout 118 is normally attached to the tube 116 before the cassette 80 is inserted into the box since it is easier to connect in this position and does not require reaching deep into the box to make the connection. The cassette, when preconnected with the filler spout 118, may be slightly open when inserted into the box 90.

As shown in FIGS. 10 and 11, after the cassette has been positioned material is fed through the filler tube 116 which starts to fill the bag 70. As the bag 70 fills it unfolds the reinforcing flaps 58, 60, 62 and 64 and moves each of them into face to face relationship with their adjacent side wall 106, 114, 112 and 104 respectively of the carton 90.

It will be apparent that the spacing panels 50, 52, 54, and 56 are moved into face to face relationship with their respective adjacent side walls of the carton 90 when the cassette is unfolded to the final horizontal position shown in FIG. 9 and that the reinforcing flaps are then folded from a position perpendicular to these panels into a position in the same plane as these panels against their respective carton walls. It has been found that providing a main flap in face to face relationship with each carton wall provides significant reinforcement to the container.

The filler spout 72 is withdrawn from the hole 68 before the cassette 80 is introduced into the carton 90, i.e. just before the filler tube 116 is connected to the filler spout 118 on the bag 70.

Folding of the flap 64 in a position against its respective wall 104 as the bag 70 is filled moves the emptying spout 72, which is accurately located by the positioning of the cassette 80 in the bottom of the container 90, into the aperture 120 (see FIGS. 10 and 11) so that the spout 72 is easily accessible when the carton is filled.

In the illustrated embodiment, the cross section of the carton 90 and thus of the main panel bottom panel 12 is substantially square, thus when the cassette is in its folded condition illustrated in FIG. 2, all corners of the two side panels are in substantial alignment, i.e. when the side panels 20 and 22 are folded perpendicular to the diagonal wall 18, the corners of these side walls 20 and 22 remote from fold lines 14 and 16 are in alignment and are located mid-length of the panel 18.

In all cases the size and shape of the main bottom panel 12 will substantially correspond with the cross of the carton with which the cassette is to be used. If the shape of the container or carton 90 is other than square, for example if the cross section of the carton were rectangular, then the two points of the side panels 20 and 21 would be spaced equally on opposite sides of the centre of the panel 18.

The present invention may also be applied to cassettes adapted to fit cartons with other cross sectional shapes. Generally with regular shaped polygons, (i.e. polygons having equal length sides) having an equal number of sides, the corners between the sides of the polygon on opposite sides of a diagonal panel equivalent to the panel 18 will be symmetrically positioned relative to the centre of the diagonal panel and will completely enclose the bag when in folded condition equivalent to that shown in FIG. 2.

For cartons having cross sectional shapes other than those with equal sides, it may be necessary to adjust the size of the reinforcing flaps equivalent to, for example the flaps 58 and 60 to ensure that sufficient protection is provided for the bag when the cassette is in the folded condition such as that illustrated in FIG. 2.

Having described the invention, modifications will be evident to those skilled in the art without departing from the spirit of the invention as defined in the appended claims.

I claim:

1. A blank for a bag cassette comprising a main bottom panel, a pair of spaced diagonal fold lines extending diagonally across said bottom panel to divide said bottom panel into a diagonal panel and a pair of side panels, main flaps connected to said side panels, each said main flap being foldably connected to its respective said side panel by first fold line, a second fold line on each of said main flaps parallel to said first fold line and dividing its respective said main flap into a spacing panel between said first and second fold line and a reinforcing flap.

2. A cassette blank as defined in claim 1 wherein the width of said diagonal panel is equal to the spacing between pair of parallel diagonal fold lines and wherein the sum of the spacing between said first and said second fold lines on a pair of main flaps connected one to one of said side panels and the other to the other of said side panels is substantially equal to the width of said diagonal panels.

3. A cassette blank as defined in claim 1 wherein said main bottom panel is substantially square and said side panels are triangular and two main flaps are provided on each side panel, said first fold lines defining two sides of each said side panel.

4. A cassette blank as defined in claim 2 wherein said main bottom panel is substantially square and said side panels are triangular and two main flaps are provided on each side panel, said first fold lines defining two sides of each said side panel.

5. A cassette blank as defined in claim 2 further comprising means for securing a spout of a bag to one of said reinforcing flaps.

6. A cassette blank as defined in claim 4 further comprising means for securing a spout of a bag to one of said reinforcing flaps.

7. A bag cassette comprising a main bottom panel, a pair of spaced parallel diagonal fold lines extending diagonally across said bottom panel to divide said bottom panel into a diagonal panel and a pair of side panels, said main bottom panel being substantially rectangular and said side panels being substantially triangular, one edge of each of said triangular side panels being formed by its respective one of said parallel diagonal fold lines connecting said side panel to said diagonal panel, main flaps connected one to each of the remaining edges of said triangular side panels by a first fold line. a second fold line on each of said main flaps, each of said second fold lines being parallel to the first fold line on its respective said main flap and dividing it respective main flap into a spacing panel in a reinforcing flap, a collapsed bag having a spout integrally connected thereto, means for connecting said spout to one of said reinforcing flaps, said spout projecting through said one reinforcing flap, said spacer panels being folded into a position substantially perpendicular to their respective said side panels on said first fold lines and said reinforcing flaps being folded into a position substantially perpendicular to their respective said spacing panels on said second fold lines and said side panels being folded substantially perpendicular to said diagonal panel on said pair of parallel diagonal fold lines.

8. A cassette as defined in claim 7 wherein said main bottom panel is substantially square.

9. A cassette as defined in claim 7 wherein another of said flaps is provided with an aperture through which said projecting spout is received.

10. A cassette as defined in claim 7 wherein the width of said diagonal is determined by the spacing of said pair of parallel diagonal fold lines and wherein the width of each of said spacer panel is determined by the spacing between its respective first and second fold lines and wherein the width of said diagonal panel is substantially equal to the combined width of said spacing panel on a pair of main flaps connected one to one of said side panels and the other to the other of said side panels.

* * * * *